US007222509B2

(12) United States Patent
Tsuda et al.

(10) Patent No.: US 7,222,509 B2
(45) Date of Patent: May 29, 2007

(54) GROOVE PROCESSING APPARATUS AND GROOVE PROCESSING METHOD

(75) Inventors: Naomasa Tsuda, Tokyo (JP); Kazuhiro Kondo, Sakaki-machi (JP)

(73) Assignees: Kayaba Industry Co., Ltd., Tokyo (JP); Yanagisawa Seiki Mfg. Co., Ltd., Nagano (JP)

( * ) Notice: Subject to any disclaimer, the term of this patent is extended or adjusted under 35 U.S.C. 154(b) by 345 days.

(21) Appl. No.: 10/978,694

(22) Filed: Nov. 2, 2004

(65) Prior Publication Data

US 2007/0051150 A1 Mar. 8, 2007

(30) Foreign Application Priority Data

Nov. 7, 2003 (JP) ..... 2003-377667

(51) Int. Cl.
*B21D 1/08* (2006.01)

(52) U.S. Cl. ..... 72/113; 72/117; 72/120; 72/370.21; 72/208

(58) Field of Classification Search ..... 72/113, 72/117, 120, 208, 214, 75, 370.21, 482.1, 72/482.3, 482.4; 267/64.12, 64.15; 92/143; 29/896.93

See application file for complete search history.

(56) References Cited

U.S. PATENT DOCUMENTS

| | | | | |
|---|---|---|---|---|
| 4,643,011 | A | 2/1987 | Wössner et al. | |
| 4,866,966 | A | 9/1989 | Hagen | |
| 6,425,279 | B1 * | 7/2002 | Jeffries | 72/370.21 |
| 6,715,327 | B2 * | 4/2004 | Klingel | 72/75 |
| 7,107,805 | B2 * | 9/2006 | Osterlanger et al. | 72/76 |

FOREIGN PATENT DOCUMENTS

| | | |
|---|---|---|
| GB | 2 280 628 A | 2/1995 |
| JP | 2001-009525 | 1/2001 |

* cited by examiner

*Primary Examiner*—Ed Tolan
(74) *Attorney, Agent, or Firm*—Rabin & Berdo, P.C.

(57) ABSTRACT

The holder member 4 is rotatably supported at the tip portion 2*a* of the sliding member 2 placed on the guide face 1*a* of the guide member 1 arranged fixedly inside the cylinder C. The holder member 4 is inclined when the tip portion 3*a* of the profiling member 3 is inserted between the holder member 4 and the sliding member 2. Then the tapered end of the processing roller 6 is pushed into the inner peripheral surface of the cylinder where the sliding member 2 and the profiling member 3 move together in the axial direction of the cylinder, thereby to form a linear groove on the inner peripheral surface of the cylinder C.

6 Claims, 1 Drawing Sheet

GROOVE PROCESSING APPARATUS AND GROOVE PROCESSING METHOD

BACKGROUND OF THE INVENTION

1. Field of the Invention

The present invention relates to a groove processing apparatus and a groove processing method of forming a groove extending in an axial direction of a cylinder on an inner peripheral surface thereof.

2. Background Information

For example, in a gas spring in which a gas is sealed inside a cylinder and the sealed gas urges a piston rod in an expanding direction thereof, there is a case where a linear groove extending in an axial direction of the cylinder is formed as a bypassing flow passage or a pressure relief groove disposed on an inner peripheral surface thereof.

Japanese Patent Publication No. 2001-9525A has disclosed a groove processing apparatus for forming a linear groove on an inner peripheral surface of a cylinder.

SUMMARY OF THE INVENTION

There are, however, the problems with workability and operationality in forming a groove on an inner peripheral surface of a cylinder a depth of which gradually changes in an axial direction of the cylinder, in particular in case where the groove is the deepest in the bottom side of the cylinder and gets gradually shallower toward the opening side of the cylinder.

In view of the above, there exists a need for a groove processing apparatus and a groove processing method which overcome the above-mentioned problems in the related art. The present invention addresses this need in the related art and also other needs, which will become apparent to those skilled in the art from this disclosure.

It is an object of the present invention to provide a groove processing apparatus and a groove processing method that are optimal for forming on an inner peripheral surface of a cylinder a groove extending in an axial direction thereof a depth of which changes in the axial direction thereof.

According to one aspect of the present invention, in order to achieve the above-mentioned object, a groove processing apparatus for forming a groove in an axial direction of a cylinder on an inner peripheral surface thereof comprises, a guide member arranged in a stationary state inside the cylinder, the guide member including a flat guide face in parallel with the axial direction of the cylinder, a sliding member located slidably on the flat guide face of the guide member and movable in the axial direction of the cylinder, a profiling member located slidably on the sliding member and movable in the axial direction of the cylinder independently of the sliding member, the profiling member having an oblique face at a tip portion thereof, and a holder member connected ratatably at an end thereof to a tip portion of the sliding member, the holder member comprising, a profiling roller disposed at a rotating end in the backside of the holder member to run on the oblique face of the profiling member, and a processing roller disposed at a mid-position of the holder member, as opposed to the inner peripheral surface of the cylinder, wherein the profiling roller runs on the oblique face of the profiling member to incline the holder member and thereby to push the processing roller into the inner peripheral surface of the cylinder where the sliding member and the profiling member move in the axial direction of the cylinder relative to the cylinder and the guide member to form a groove extending in the axial direction on the inner peripheral surface of the cylinder.

These and other objects, features, aspects and advantages of the present invention will be become apparent to those skilled in the art from the following detailed description, which, taken in conjunction with the annexed drawings, discloses a preferred embodiment of the present invention.

BRIEF EXPLANATION OF THE DRAWINGS

Referring now to the attached drawings which form a part of this original disclosure.

DETAILED DESCRIPTION OF THE PREFERRED EMBODIMENT

A selected embodiment of the present invention will now be explained with reference to the drawings. It will be apparent to those skilled in the art from this disclosure that the following description of the embodiment of the present invention is provided for illustration only, and not for the purpose of limiting the invention as defined by the appended claims and their equivalents.

Figure 1:
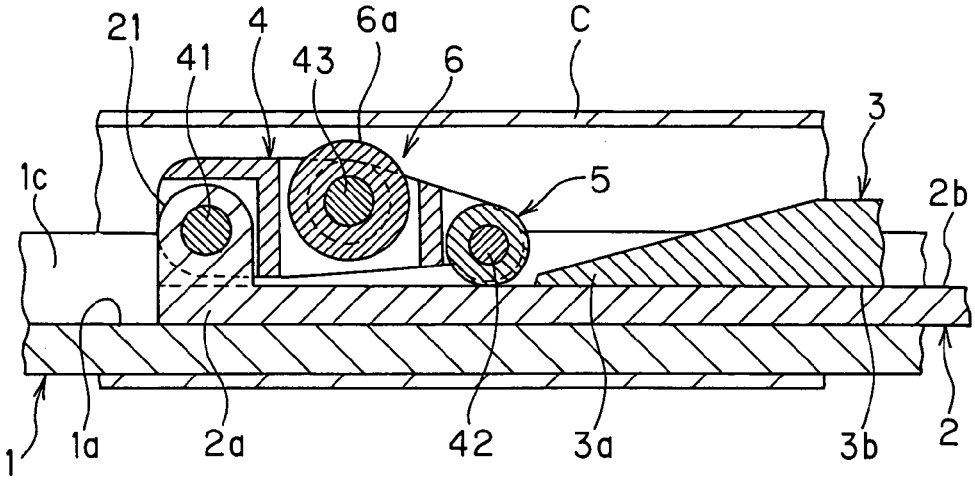
FIG. 1 is a cross sectional view showing a preferred embodiment of the present invention.
Figure 2:
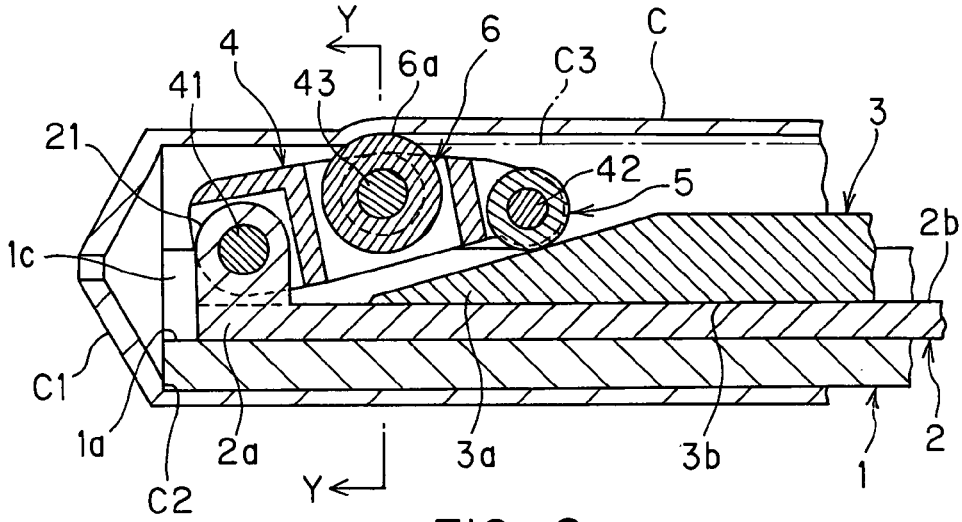
FIG. 2 is a cross sectional view showing a groove processing state.
Figure 3:
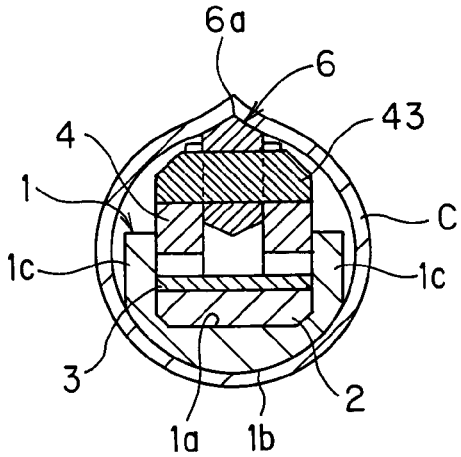
FIG. 3 is a cross sectional view taken on lines Y—Y in FIG. 2.

FIGS. 1–3 show a groove processing apparatus in a preferred embodiment of the present invention. The groove processing apparatus is provided with a guide member 1, a sliding member 2, and a profiling member 3, and further a holder member 4 disposed in the sliding member 2, as well as a profiling roller 5 and a processing roller 6 disposed in the holder member 4.

The guide member 1 is, for example, located and inserted into a cylinder C as a component of a gas spring to be stationary therein for groove processing. The guide member 1 has a flat guide face 1*a* extending in an axial direction of the cylinder C to slidably guide the sliding member 2.

The cross section of the guide member 1 is formed in U-shape and a guide side wall 1*c* is formed in each side of the guide face 1*a*. And a bottom face 1*b* of the guide member 1 is formed in a curved face having a curvature that corresponds to the inner peripheral surface of the cylinder C and closely contacts the inner peripheral surface of the cylinder C.

The guide member 1, for example, is inserted from an opening end (not shown) in the right side of FIG. 1 and FIG. 2 into the cylinder C and is fixed thereto. In this case an insertion end of the guide member 1 bumps into an inside step portion C2 of a bottom end C1 of the cylinder C to prevent further movement of the guide member 1 in the insertion direction (refer to FIG. 2).

The sliding member 2 is placed on the guide face 1*a* of the guide member 1 and slides along the guide face 1*a* in the axial direction of the cylinder C by a driving force applied to an operation portion in a base side (not shown). The sliding member 2 is formed in a band sheet shape and has both ends contacting each guide side wall 1*c*, 1*c* of the guide member 1 to restrict movement of the sliding member 2 in the direction perpendicular to the sliding direction thereof.

A bracket 21 is disposed in a tip portion 2*a* of the sliding member 2 and one end of the holder member 4 is rotatably supported by the bracket 21 through a horizontal shaft 41. A profiling roller 5 is rotatably supported by a horizontal shaft 42 in a rotating end extending in the backside of the holder member 4. A lower face of the profiling roller 5 extends further than a lower face of the holder member 4 to directly roll on and contact an upper face 2*b* of the sliding member 2.

Further, a processing roller 6 is rotatably supported at the holder member 4 by a horizontal shaft 43 positioned in an intermediate position between both shafts 41 and 42. A part of the processing roller 6 is in an upper position than an upper face of the holder member 4 and a tapered end 6*a* is formed in a central portion of an outer peripheral surface of the processing roller 6. This tapered end 6*a* performs groove processing on the inner peripheral surface of the cylinder as described later.

The profiling member 3 extending in the axial direction of the cylinder C the same as the sliding member 2 is placed on the upper face 2*b* of the sliding member 2, and a tip portion 3*a* of the profiling member 3 includes an oblique face. The profiling member 3 is so constructed that the profiling member 3 moves together with the sliding member 2 in the axial direction of the cylinder C or independently thereof as needed.

The oblique face of the tip portion 3*a* gradually gets lower in height toward the left side in FIG. 2, and the profiling roller 5 in a rotating end of the holder member 4 runs on the tip portion 3*a* of the profiling member 3 to incline the holder member 4 at any angle depending on a point where the profiling roller 5 is on the oblique face of the tip portion 3*a* and thereby to push the tapered end 6*a* of the processing roller 6 into the inner peripheral surface of the cylinder C. It is noted that the profiling roller 5 is formed in a cylindrical shape and contacts the oblique face of the tip portion 3*a* with the entire width of the profiling roller 5 to avoid locally excessive contact with the oblique face and thereby to prevent damage or deformation of the oblique face.

A part of the holder member 4 is placed between the guide side walls 1*c*, 1*c* of the guide member 1, which enables restriction of right side and left side movements of the holder member 4. As a result, the processing roller 6 held by the holder member 4 is guided not to move in the direction perpendicular to the axial direction of the cylinder C.

It is preferable to ensure good sliding performance of the profiling member 3 on the sliding member 2. For example, a slip member such as Teflon (registered trademark) is located on either one of the upper face 2*b* of the sliding member 2 and the lower face 3*b* of the profiling member 3 sliding with the upper face 2*b* or a bearing member such as a steel ball or a roller is arranged between the lower face 3*b* of the profiling member 3 and the upper face 2*b* of the sliding member 2 (not shown).

An operation portion in the backside of the profiling member 3 in the right side in FIGS. 1 and 2 is positioned outside of the opening end of the cylinder C (not shown). Driving force exerting on the operation portion causes the profiling member 3 to slide on the upper face 2*b* of the sliding member 2.

Groove processing by the groove processing apparatus of the preferred embodiment according to the present invention will be performed as follows.

As shown in FIG. 2, the sliding member 2 is inserted to the leading edge of the guide member 1 and thereafter, the profiling member 3 is inserted from the state shown in FIG. 1 to the state shown in FIG. 2 to slide the tip portion 3*a* down the lower face of the holder member 4. Then, as shown in FIGS. 2 and 3, the profiling member 5 runs on the oblique face of the tip portion 3*a* of the profiling member 3 to incline the holder member 4. As a result, the processing roller 6 lifts up, so that the tapered end 6*a* cuts into the inner peripheral surface of the cylinder C.

In this state, when the sliding member 2 is moved together with the profiling member 3 on the guide member 1 in the right side direction in FIG. 2, the processing roller 6 moves while rolling, whereby a linear groove C3 is formed on the inner peripheral surface of the cylinder C a length of which corresponds to the distance by which the sliding member 2 moves.

Next, when the profiling member 3 moves relative to the sliding member 2 in the right direction in FIG. 2, the profiling roller 5 comes down on the oblique face of the tip portion 3*a*, so that the tapered end 6*a* of the processing roller 6 lowers. Therefore, as the sliding member 2 moves in the right direction in FIG. 2 and at the same time the profiling member 3 moves in the same direction with the sliding member 2 at a slightly faster speed than the sliding member 2, the depth of the groove C3 formed on the inner peripheral surface of the cylinder C gradually gets shallower.

And when the profiling member 3 moves at a faster speed in the right direction in FIG. 2 as compared to the sliding member 2 or only the profiling member 3 is moved with the sliding member 2 being still stopped, the processing roller 6 rapidly lowers down and then, the tapered end 6*a* leaves from the inner peripheral surface of the cylinder C, and at that point the processing of the groove C3 ends.

Accordingly in the preferred embodiment of the present invention, the groove C3 can be formed on the inner peripheral surface of the cylinder C so as to have any depth and any length based upon an initial position of the sliding member 2 to the guide member 1, an initial position of the profiling member 3 to the sliding member 2, a relative movement speed between the sliding member 2 and the profiling member 3, and the like.

It is noted that the cylinder C and the guide member 1 are arranged to be fixedly held, and the sliding member 2 and the profiling member 3 are arranged to be moved to perform groove processing, and however, in place of the above arrangement, while the sliding member 2 and the profiling member 3 are arranged to be stationary, the cylinder C and the guide member 1 are arranged to be moved, to enable groove processing.

This application claims priority to Japanese Patent Application No. 2003-377667. The entire disclosure of Japanese Patent Application No. 2003-377667 (filed on Nov. 07, 2003) is hereby incorporated herein by reference.

While only the selected embodiment has been chosen to illustrate the present invention, it will be apparent to those skilled in the art from this disclosure that various changes and modifications can be made herein without departing from the scope of the invention as defined in the appended claims. Furthermore, the foregoing description of the embodiment according to the present invention is provided for illustration only, and not for the purpose of limiting the invention as defined by the appended claims and their equivalents.

What is claimed is:

1. A groove processing apparatus for forming a groove in an axial direction of a cylinder on an inner peripheral surface thereof, comprising:

a guide member (1) arranged in a stationary state inside the cylinder, the guide member including a flat guide face (1*a*) in parallel with the axial direction of the cylinder;

a sliding member (2) located slidably on the flat guide face (1*a*) of the guide member and movable in the axial direction of the cylinder;

a profiling member (3) located slidably on the sliding member (2) and movable in the axial direction of the cylinder independently of the sliding member, the profiling member having an oblique face at a tip portion (3*a*) thereof; and a holder member (4) connected rotatably at one end thereof to a tip portion of the sliding member (2), the holder member comprising:

a profiling roller (5) disposed at a rotating end in the backside of the holder member (4) to run on the oblique face of the profiling member (3); and a processing roller (6) disposed at a mid-position of the holder member (4), as opposed to the inner peripheral surface of the cylinder, wherein:

the profiling roller (5) runs on the oblique face of the profiling member (3) to incline the holder member (4) and thereby to push the processing roller (6) into the inner peripheral surface of the cylinder where the sliding member (2) and the profiling member (3) move in the axial direction of the cylinder relative to the cylinder and the guide member (1) to form a groove extending in the axial direction on the inner peripheral surface of the cylinder.

2. The groove processing apparatus according to claim 1, wherein:

the processing roller (6) comprises a tapered portion formed by tapering an outer peripheral surface.

3. The groove processing apparatus according to claim 1, wherein:

the profiling roller (3) is formed in a cylindrical shape, and the profiling roller contacts the oblique face at an entire width of the profiling member when the profiling roller runs on the oblique face.

4. The groove processing apparatus according to claim 1, wherein:

the guide member (1) comprises side walls (1*c*) in both sides of the guide face (1*a*), the side walls preventing movement of the holder member (4) in the direction perpendicular to the axial direction of the cylinder.

5. A groove processing method of forming a groove in an axial direction of a cylinder on an inner peripheral surface thereof, comprising the steps:

arranging a guide member (1) in a stationary state inside the cylinder, the guide member including a flat guide face (1*a*) in parallel with the axial direction of the cylinder;

locating a sliding member (2) slidably on the flat guide face (1*a*) of the guide member and movable in the axial direction of the cylinder;

locating a profiling member (3) slidably on the sliding member (2) and movable in the axial direction of the cylinder independently of the sliding member, the profiling member having an oblique face at a tip portion thereof; and providing a holder member (4) connected rotatably at one end thereof to a tip portion of the sliding member (2), the holder member comprising:

a profiling roller (5) disposed at a rotating end in the backside of the holder member to run on the oblique face of the profiling member (3); and a processing roller (6) disposed at a mid-position of the holder member (4), as opposed to the inner peripheral surface of the cylinder, wherein:

the profiling roller (5) runs on the oblique face of the profiling member (3) to incline the holder member (4) and thereby to push the processing roller into the inner peripheral surface of the cylinder where the sliding member (2) and the profiling member (3) move in the axial direction of the cylinder relative to the cylinder and the guide member (1) to form a groove extending in the axial direction on the inner peripheral surface of the cylinder.

6. The groove processing method according to claim 5, wherein:

making a difference in movement speed between the sliding member (2) and the profiling member (3) causes a change in depth of the groove formed on the inner peripheral surface of the cylinder.

* * * * *